United States Patent [19]

Chang

[11] 4,099,773

[45] Jul. 11, 1978

[54] COUPLES CHAIR

[76] Inventor: James F. Chang, 3821 SW. 88 Pl., Miami, Fla. 33165

[21] Appl. No.: 802,127

[22] Filed: May 31, 1977

[51] Int. Cl.[2] ..... A47C 3/02

[52] U.S. Cl. ..... 297/270; 128/33; 272/56; 297/247; 297/258; 297/DIG. 3

[58] Field of Search ..... 297/247, 258, 270, 272, 297/DIG. 3; 128/33; 272/56

[56] References Cited

U.S. PATENT DOCUMENTS

| | | | |
|---|---|---|---|
| 246,458 | 8/1881 | Chandler | 297/247 X |
| 1,312,382 | 8/1919 | Benas | 297/247 X |
| 3,029,109 | 4/1962 | Nail | 297/DIG. 3 |
| 3,526,429 | 9/1970 | Metzger | 297/258 |
| 3,653,375 | 4/1972 | Raffel | 128/33 |
| 3,781,931 | 1/1974 | Knickerbocker | 272/56 X |

*Primary Examiner*—James C. Mitchell
*Attorney, Agent, or Firm*—Sherman Levy

[57] ABSTRACT

An article of furniture that includes a curved lower outer surface so that the article of furniture or chair can be rocked back and forth, the chair including stop members for limiting rocking motion or movement of the chair, and wherein reinforced portions are provided for supporting occupants of the chair so that the occupants will not sink down too far in the chair.

1 Claim, 5 Drawing Figures

COUPLES CHAIR

BACKGROUND OF THE INVENTION

FIELD OF THE INVENTION

The present invention relates to an article of furniture, and more particularly to a chair for conveniently supporting several persons thereon.

In accordance with the present invention, there is provided a chair that can be rocked back and forth by persons sitting thereon, and wherein the chair can be inflated with air when the chair is being used, and wherein when the chair is not being used air can be let out of the same so that the chair can be moved to a folded, collapsed position to occupy a minimum amount of space for storage or shipment.

The primary object of the present invention is to provide a chair for supporting couples therein or thereon and for example the chair can be conveniently used by a husband and wife, the chair providing a pleasant and relaxing action due to the dynamics and configuration of the chair, inasmuch as the chair can be rocked back and forth with the couples supported thereon.

Still another object of the present invention is to provide a couples chair that is uniquely constructed to be used by two persons and wherein the persons are not to be seated next to each other as in a conventional chair but rather in front of each other so as to provide an atmosphere of closeness and intimacy that previous chairs to not generally produce.

A still further object of the present invention is to provide a couples chair that is adapted to be used by the occupants in a straddled position with their legs on the sides of the chair and their feet on the floor so as to provide full control of the rocking movement with one's legs.

Another object of the present invention is to provide a chair that has improved characteristics and advantages as compared to previous chairs.

Still another object of the present invention is to provide a couples chair that is generally rugged in construction and simple and inexpensive to manufacture.

Other objects and advantages of the present invention will become apparent in the following specification when considered in the light of the attached drawings.

DESCRIPTION OF THE PREFERRED EMBODIMENT

Figure 1:
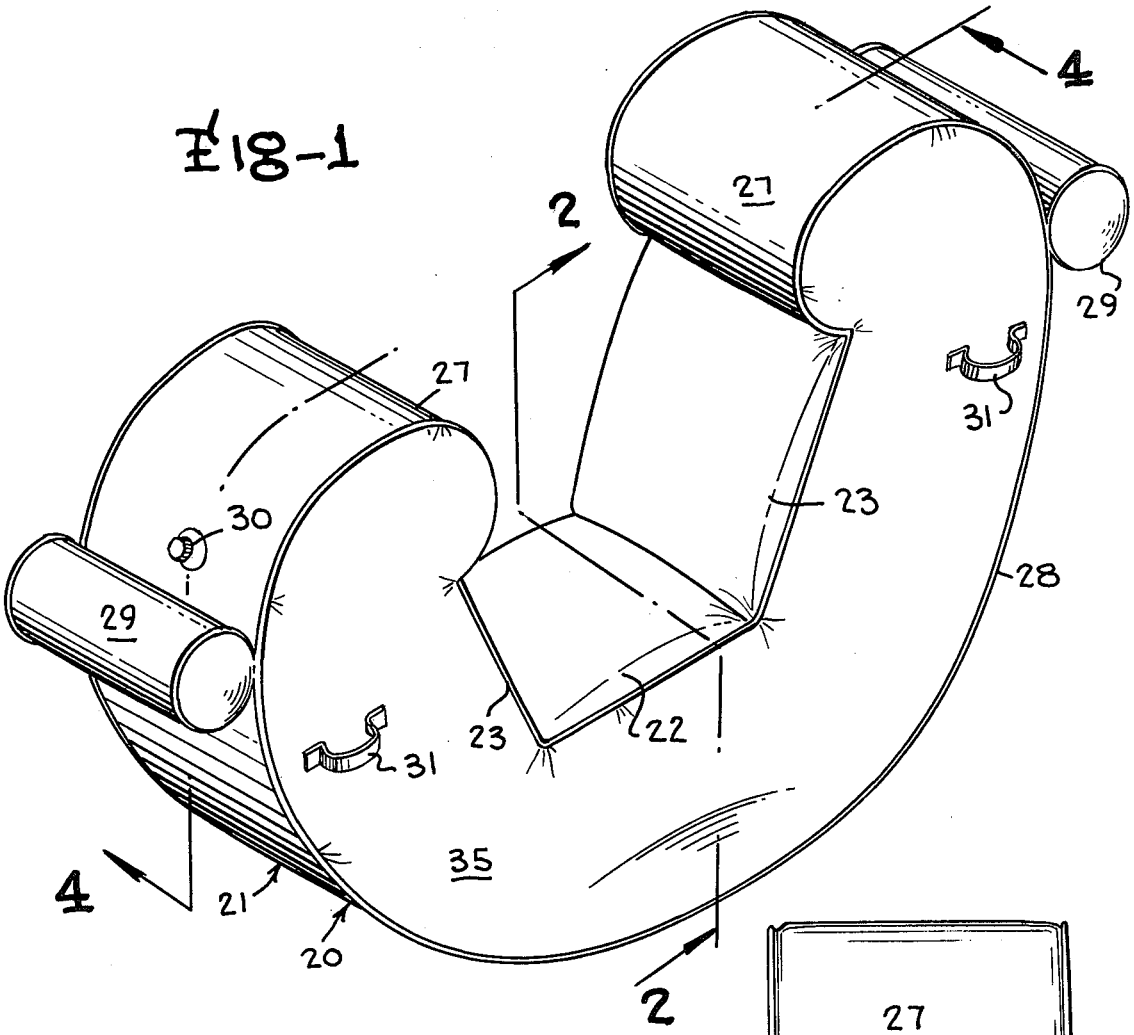
FIG. 1 is a perspective view of the couples chair of the present invention.

Referring in detail to the drawings, the numeral 20 indicates an article of furniture consisting of a chair that includes an inflatable body member 21, FIG. 1. A base section 22 is provided, and inclined back sections 23 are hingedly connected to the base section 22 as at 26, FIG. 4. The base section 22 and incline back sections 23 are hollow and are adapted to have mounted therein reinforcing elements or support pieces 24 that can have cushions 25 contiguous to the outer surface thereof, FIG. 4.

Figure 5:
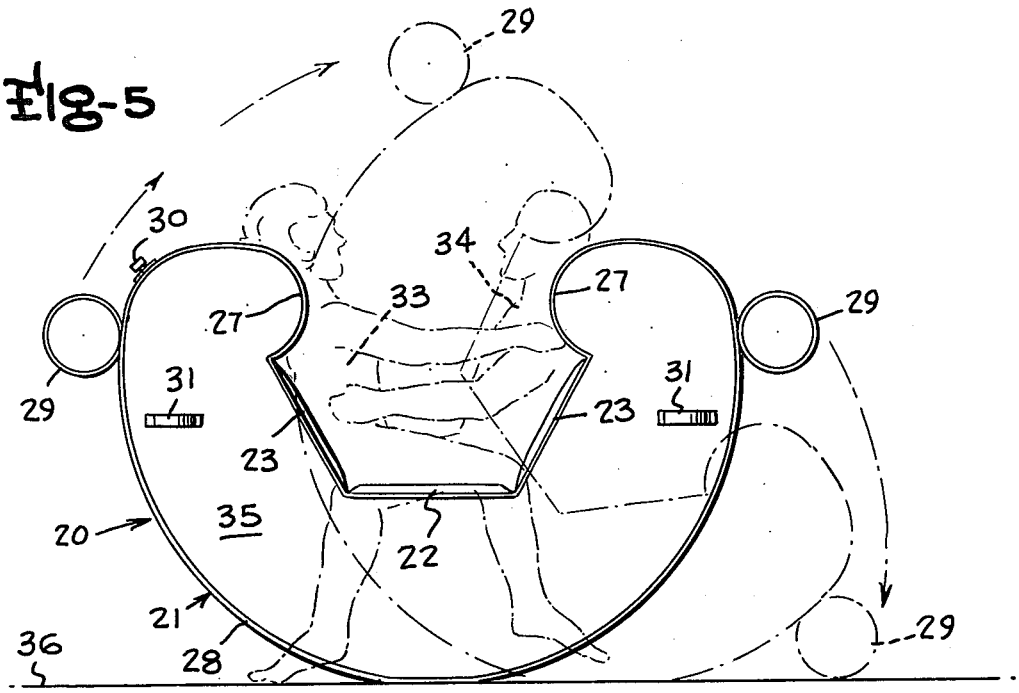
FIG. 5 is a side elvational view illustrating the rocking movement that can be achieved with the chair of the present invention.

The chair 20 further includes curved end sections 27 that can provide a convenient support for the neck or head and shoulders of the occupants as shown in FIG. 5. The chair 20 further includes a curved bottom section 28. Formed integral with the outer upper end portions of the chair are cylindrical portions 29 that provide stop members for limiting rocking movement of the chair.

Figure 3:
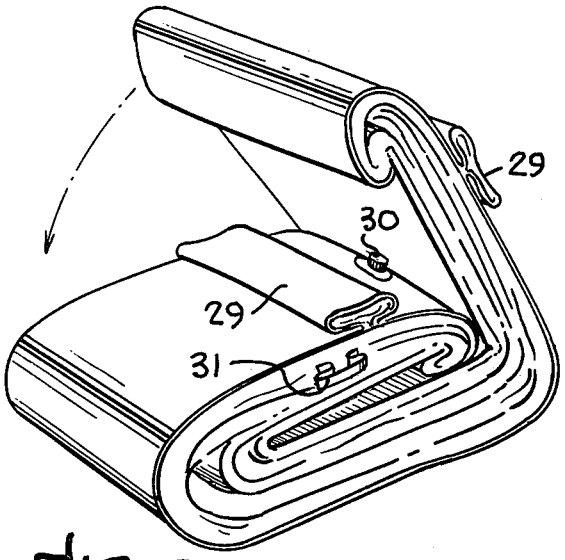
FIG. 3 is a perspective view showing the chair deflated so that it can be collapsed and stored or shipped in a compact position.
Figure 2:
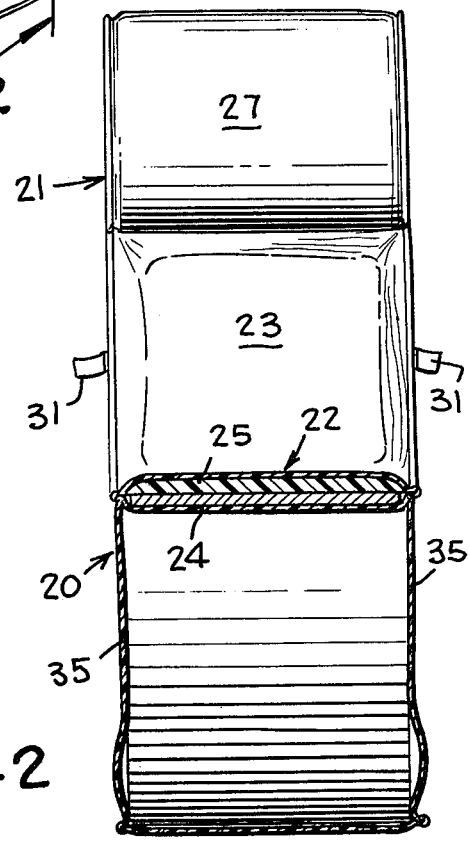
FIG. 2 is a sectional view taken on the line 2—2 of FIG. 1.

A fitting 30 is provided on the chair so that when the chair is being used by couples, air under pressure can be introduced into the hollow interior of the chair through the fitting 30, and when the chair is not being used, the air can be let out of the interior of the chair through the fitting 30 so that the chair can be folded as shown in FIG. 3 to occupy a minimum amount of space for storage and shipment.

The chair is further provided with straps or stirrups 31 that are formed integral or secured to the spaced parallel side portions 35 of the chair, FIG. 1.

Figure 4:
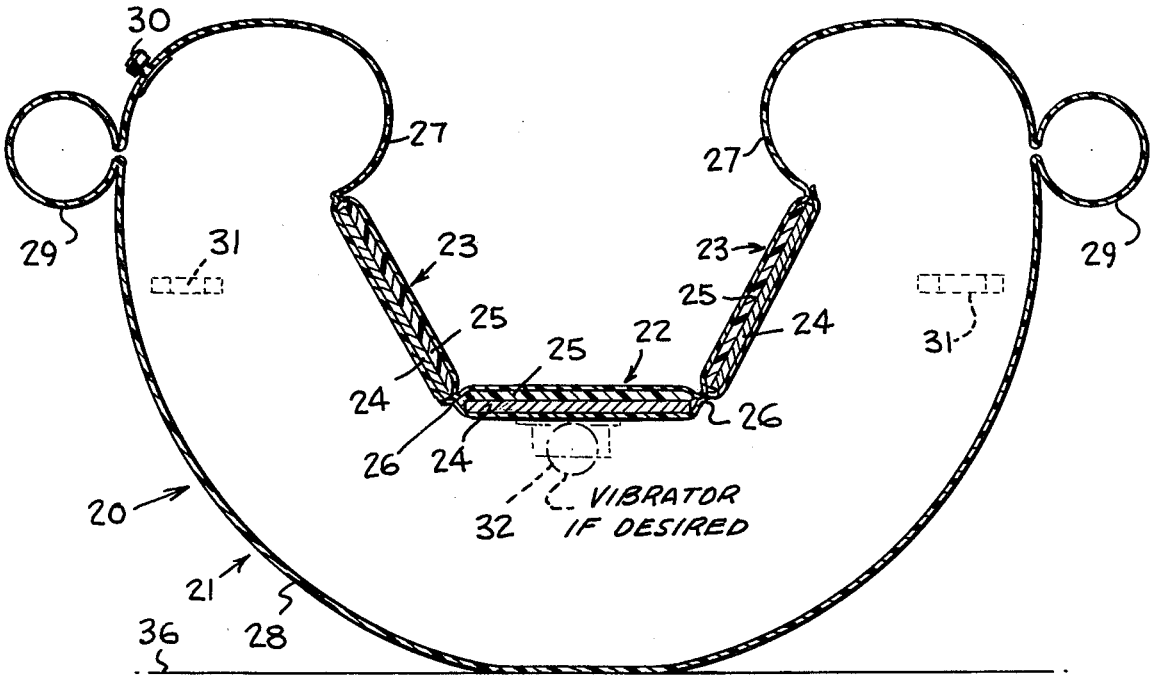
FIG. 4 is a sectional view taken on the line 4—4 of FIG. 1.

If desired, one or more vibrators 32 can be provided for the chair as shown in FIG. 4. For example, such vibrators 32 can be conveniently mounted under the seat or base portion 22. In FIG. 5 in dotted or broken lines the numerals 33 and 44 indicate persons seated in the chair of the present invention.

In FIGS. 4 and 5 the numeral 36 indicates a floor surface or supporting surface upon which the chair 20 can be rocked back and forth.

From the foregoing, it will be seen that there has been provided a couples chair, and in use with the parts arranged as shown in the drawings, the chair 20 is especially suitable and convenient for supporting couples such as the couples 33 and 34 shown in broken lines in FIG. 5. With the couples or husband and wife seated on the portion 22, the chair 20 can be rocked back and forth so that a highly pleasing and stimuating atmosphere can be achieved. It is to be understood that when the chair is being used, the chair is inflated with air through the valve or fitting 30, and when the chair is not being used, the chair can be folded or collapsed as shown in FIG. 3. The stop portions 29 are formed integral with or secured to the chair so that, for example, as shown in FIG. 5, these portions 29 will act as stop members to prevent the chair from rocking too far in either direction, since the stop portions 29 will engage the floor surface 36 when the chair is rocked a certain distance. The straps 31 can be conveniently used when desired to permit the occupants to place their hands or feet in engagements therewith. The portions 22 and 23 are adapted to be provided with reinforced elements 24 as well as cushion like elements 25 and this construction serves to assure that the occupants will not sink down too low in the chair and also permits the occupants to sit in the chair with maximum comfort. If desired, one or more vibrators 32 can be mounted in the chair to provide a means of stimulation for the users of the chair or to enhance the effect provided by the chair.

While the chair has been illustrated as being made of an inflatable material, it is to be understood that the chair can be made of non-inflatable material; that is, if desired, it can be made so that it has a rigid formation.

The parts can be made of any suitable material and in different shapes and sizes as desired or required.

The straps 31 can be used for resting the feet thereon. The surfaces 22 and 23 can be in the nature of hard upholstered surfaces made of wood or plastic, and vibrators can be attached under these surfaces.

As is well known, people appear to be living under greater stress and in some instances married people have a tendency to grow apart from each other and the furniture of the present invention is made for two people such as a husband and wife, so that the users can converse and relax at the same time. The users do not sit next to each other looking in different directions or perhaps watching television, but instead look at each other and perhaps converse and at the same time rock themselves by the common and mutual action of their legs and bodies. In other words, they can do something that is pleasant and relaxing together. Or, one of the partners may rock the other by his or her own single action and thus do something that is pleasant and relaxing for the other. The chair also has a dynamic action since both legs are preferably on the floor or in an upright position. Hence, the chair is not made to be slept on but rather to improve the chances of couples to better understand each other by providing a means for improved interrelationship between the couples that other chairs cannot achieve.

A further advantage of the chair of the present invention is that it can be made inexpensively from inflatable plastic material and at the same time solve the big problem of storage. The chair can have a rocking action of approximately 120 degrees so as to permit the chair to become a playful object. As previously noted, the couples chair can be made of an inflatable vinyl material or other plastics, or the chair can be made of other materials such as metal or wood that is properly upholstered and it can be made of one or more pieces and can be made in any desired color. The chair can be used by couples rocking together, or by one person rocking the other.

The couples chair of the present invention is uniquely constructed to be used by two persons and these two persons are not to be seated next to each other as in a conventional chair, but rather in front of each other so as to achieve an atmosphere of closeness and intimacy that other chairs cannot produce. The couples chair, because of its construction must be sat in in a straddled position; in other words, with the legs on the side of the chair and the feet on the floor, so as to permit full control of the rocking movement with one's legs. The couples chair is of a simple and modern design and is inexpensive to make. There are no sharp, uncomfortable edges and in fact the chair utilizes rounded and soft edges. The chair has a unique rocking action and the chair has the members or portions 29 at each end that function as safety features to prevent the rocking action from turning the chair over. The chair does not contain any mechanical or clamping devices or any moving parts and does not require assembly of the same. The chair can be made of inflatable vinyl or other synthetic materials and by letting the air out the chair can be collapsed and easily stored, transported, or shipped. The chair can be easily inflated with a vacuum cleaner, small hand pump or the like. The couples chair promotes the cooperation of marriage partners so that they will have a tendency to do something together which is pleasant and relaxing at the same time as a rocking motion is provided. The couples chair also will help promote the idea of doing something for one's loved one since one of the partners can rock the other by his or her own single action and thus provide the pleasant and relaxing motion for the other person. A dynamic quality is provided since the legs are either on the side, resting on the floor, or up in the straps. The chair is definitely not made for people to sleep in. When being used by only one person, due to the lack of counterweight, the rocking motion can be very taxing on the legs and back so that it will provide a good form of exercise. Further, it can be used by both partners as an exerciser if both push themselves in opposite directions from each other.

It will now be clear that there is provided a device which accomplishes the objectives heretofore set forth. While the invention has been disclosed in its preferred form, it is to be understood that the specific embodiment thereof as described and ilustrated herein is not to be considered in a limited sense as there may be other forms or modifications of the invention which should also be construed to come within the scope of the appended claims.

What is claimed is:

1. In an article of furniture, an inflatable rocking chair including a base section, inclined back sections hingedly connected to said base section, said base section and inclined back sections being hollow, support pieces mounted on said inclined sections and said support pieces having cushions contiguous to the outer surfaces thereof, said chair further including curved end sections and a curved bottom section, cylindrical portions formed integrally with the outer upper end portions of the chair and said cylindrical portions providing stop members for limiting rocking movement of the chair, a fitting provided on said chair so that when the chair is being used, air under pressure can be introduced into the hollow interior of the chair through the fitting, and wherein when the chair is not being used, the air can be let out of the interior of the chair through the fitting so that the chair can be folded to occupy a minimum amount of space for storage and shipment, said chair further including spaced parallel side portions, and straps secured to said spaced parallel side portions.

* * * * *